United States Patent [19]

Nakao et al.

[11] Patent Number: 4,567,934

[45] Date of Patent: Feb. 4, 1986

[54] COOLING MECHANISM FOR USE IN CONTINUOUS METAL CASTING

[75] Inventors: Masakazu Nakao, Kobe; Koro Takatsuka, Akashi; Shohei Murakami, Hyogo; Hiroshi Takagi, Kobe; Yoshinori Onoe, Akashi; Hiraku Tsuchiya; Satoru Ikenaga, both of Kobe; Michihisa Taguchi, Hyogo, all of Japan

[73] Assignee: Kabushiki Kaisha Kobe Seiko Sho, Kobe, Japan

[21] Appl. No.: 582,730

[22] Filed: Feb. 23, 1984

[30] Foreign Application Priority Data

Feb. 28, 1983 [JP] Japan ..... 58-32476
Mar. 11, 1983 [JP] Japan ..... 58-36102[U]

[51] Int. Cl.[4] ..... B05B 13/02; B22D 11/124

[52] U.S. Cl. ..... 164/444; 164/416; 164/447; 239/434; 239/568

[58] Field of Search ..... 239/407, 434, 557, 567, 239/568; 164/422, 447, 444, 416, 414

[56] References Cited

U.S. PATENT DOCUMENTS

| | | | |
|---|---|---|---|
| 3,882,924 | 5/1975 | Fujikawa | 164/416 |
| 3,885,741 | 5/1975 | Wagener et al. | 239/568 |
| 3,931,848 | 1/1976 | Schmid | 164/416 |
| 3,946,792 | 3/1976 | Thalmann | 164/414 |
| 3,981,350 | 9/1976 | Chielens et al. | 164/447 |
| 4,250,951 | 2/1981 | Mezger et al. | 164/444 |
| 4,476,914 | 10/1984 | Wrossok | 164/444 |
| 4,483,482 | 11/1984 | Junger et al. | 239/434 |

FOREIGN PATENT DOCUMENTS

| | | | |
|---|---|---|---|
| 908494 | 3/1982 | U.S.S.R. | 164/444 |

*Primary Examiner*—W. D. Bray
*Attorney, Agent, or Firm*—Oblon, Fisher, Spivak, McClelland & Maier

[57] ABSTRACT

At least two exhaust holes are formed in an atomizing nozzle of an apparatus for spraying an air-water mist for cooling which is used in continuous metal casting. The respective spraying mist streams from the exhaust holes cross each other before they reach the surface of a cast strand and are diffused forwardly due to the influence of the kinetic energy which is directed in the spraying direction after they crossed, so that they sufficiently enter the region between the surfaces of guide rollers and cast strand, thereby directly spraying the air-water mist over almost the entire region of the surface of the cast strand. In addition, a header is disposed in parallel to the guide rollers and a plurality of water branching pipes are attached in line to the header in the longitudinal direction thereof. The inner diameter of these water branching pipes are set to be sequentially smaller toward the lower stage. The back pressures of the atomizing nozzles are reduced by causing pressure losses in the water branching pipes coupled to the atomizing nozzles, thereby spraying a uniform flow rate of the water from each water branching pipe.

5 Claims, 23 Drawing Figures

DISTRIBUTION OF HEAT TRANSFER COEFFICIENT
(DIRECTION OF PULLING OUT A CAST STRAND)

COOLING MECHANISM FOR USE IN CONTINUOUS METAL CASTING

BACKGROUND OF THE INVENTION

1. Field of the Invention

The present invention relates to a mechanism for cooling a cast strand in continuous metal casting and, more particularly, to an air-water mist cooling method by which a cast strand can be uniformly cooled.

2. Description of the Prior Art

Although conventionally a water spraying method has been generally used for cooling a cast strand which is continuously pulled out in continuous metal casting, recently an air-water mist cooling method whereby the surface cracks of a cast strand are reduced and the quantity of the water to be consumed is relatively small and the cooling efficiency is high has become the main method utilized. Cooling of a continuous cast strand using an air-water mist spraying apparatus is performed in the manner such that an exhaust hole formed in an atomizing nozzle is disposed so as to be directed to the surface of the continuous cast strand from the portion between guide rollers, thereby spraying the mist toward the cast strand from the above portion between the guide rollers. In this case, it is desired to spray the mist over as wide a region as possible in order to uniformly cool the cast strand. However, using too large of a spreading angle $\theta$ of the spraying stream causes a part of the spraying mist to be cut off by the guide rollers, so that that part does not reach the cast strand and the mist would be ineffectively consumed, and at the same time there occurs a problem of overcooling of the guide rollers. Therefore, the spreading angle $\theta$ is controlled in accordance with the distance between the guide rollers, i.e., the angle $\theta$ is set at a value such that the outermost edges of the spraying mist almost coincide with the tangential directions of the guide rollers, so that the spreading angle $\theta$ of the spraying mist is extremely small. As a result, the surface of the cast strand to be directly cooled by the mist corresponds to only the narrow region to be covered by the small angle $\theta$, and the cooling efficiency of the regions before and behind this narrow region, is reduced since the cast strand in that region is indirectly cooled or is cooled by the air. Thus, the cooling rate of the cast strand, particularly the cooling rate of the surface portion of the cast strand instantaneously becomes nonuniform and variation occurs on the surface of the cast strand in the shrinkage portions due to the cooling, inviting an imbalance in stress, so that there is a problem that the cast strand frequently cracks (in particular, the surface thereof cracks). On the other hand, to be considered is a method disclosed in Japanese Patent Kokai (Laid-Open) No. 12347/82 whereby two exhaust holes open with a proper distance in an atomizing nozzle, thereby enlarging the mist spraying region as a whole. However, according to the experiments using such nozzle, it has been found that the cooling state of the cast strand was such that the quantity of the mist to be cut off by colliding with the guide rollers contrarily merely increased and, consequently, it was impossible to avoid the above-mentioned problem.

In addition, a cooling mechanism for use in continuous metal casting equipment comprises a header for supplying the cooling water (hereinbelow, referred to as a header), water branching pipes and atomizing nozzles and is disposed along a cast strand supporting apparatus such as guide rollers or the like. Since this cast strand supporting apparatus is vertically circular-arc-like shaped, there occurs a difference in water pressure at both upper and lower ends of the header. Therefore, in such supporting apparatus provided with the same atomizing nozzles, the resulting quantities of spraying water become uneven. More particularly, the water pressure difference when the quantity of the water is small provides a large influence. Thus, the cooling conditions in the longitudinal direction (pulling-out direction) of the cast strand become nonuniform and the cast strand cracks, causing the surface quality to deteriorate.

To solve such problems, as a method of making the quantities of the spraying water uniform, there has been conventionally known a method whereby a flow regulating valve as a fixed throttle or variable throttle is provided for each water branching pipe; the pressure loss is controlled by the opening angle of that valve; the bores of the headers are set at values which sequentially become smaller from the upper portion; pressure losses are caused in the headers; and the nozzle back pressures are reduced, thereby making the quantities of the water sprayed from all stages uniform.

However, according to the previously-mentioned conventional cooling apparatus, special tools or special processes are needed for the water branching pipes or headers. This causes the construction to be complicated and accidents may easily occur in the apparatus, thus requiring a significant amount of labor for the repair and inspection and at the same time resulting in a high production cost. Moreover, in case of an apparatus using throttles, there is a troublesome drawback in that the quantities of the spraying water have to be controlled to obtain the uniform quantities of the spraying water.

SUMMARY OF THE INVENTION

It is an object of the present invention to provide a cooling mechanism for use in continuous metal casting equipment in which a sufficient quantity of the air-water mist can be sprayed on the surface of a cast strand in order to almost uniformly cool the cast strand, thereby enabling continuous metal casting to be performed without any inconvenience such as the cracking of the cast strand to be caused due to the nonuniform cooling.

The above object is accomplished by a cooling mechanism which is constituted as follows. That is, at least two exhaust holes are provided in an apparatus for spraying the air-water mist for cooling which is used in continuous metal casting. These exhaust holes are formed so that the spraying mist streams therefrom can cross each other before they reach the surface of a cast strand, thereby increasing the quantity of the mist which is spreaded to the surface of the cast strand. The air-water mist stream after crossing is spreaded due to the influence of the kinetic energy which functions in each spraying direction and is directly sprayed on almost the entire region of the surface of the cast strand. In addition, headers are disposed in association with the guide rollers and a plurality of water branching pipes are disposed in a line in the longitudinal direction of the headers. The water branching pipes are formed so that their inner diameters become smaller toward the lower stage. The back pressure of the nozzle is reduced due to the pressure losses to be caused in the water branching pipes, so that almost uniform quantities of the cooling water are sprayed from a plurality of atomizing nozzles which are disposed at the head portions of the water branching pipes, respectively.

According to the present invention, the following effects can be obtained.

(a) Since the efficiency of the spraying mist (i.e., the ratio of the mist to be consumed for cooling the cast strand) is remarkably improved, the quantity of water to be consumed is reduced and the driving force for generating the mist (practically, the supply pressures of the water and air) is effectively utilized as much as possible, thereby enabling cooling by the air-water mist to be performed in an extremely efficient manner.

(b) Even in the case where the distance between the guide rollers is arranged to be wide, the cast strand can be uniformly cooled by setting the spreading width of the air-water mist stream after crossing into a large value.

(c) The exhaust holes can be inclined and formed so that the spreading portions thereof in the circumferential direction of the nozzle are inclined in the planes which cross at an angle $\alpha$ with respect to the central line of the atomizing nozzle, thereby enabling the machining to be simplified.

(d) After the air-water mixture is passed through a narrow orifice, it is sprayed and released into a residence chamber to produce the fine mist, thereby improving the cooling effect.

(e) Since the air-water mixture is made into a fine mist by repeatedly colliding between the inner walls in the residence chamber, the cooling effect can be further improved.

(f) It is unnecessary to use special tools or to perform special processes and the construction is simplified such that failures hardly occur and the production cost is reduced.

(g) The quantities of the spraying water can be easily controlled by merely replacing the water branching pipes by other water branching pipes with different bores.

(h) The air and water are sufficiently mixed by connecting the air branching pipes to the respective atomizing nozzles, thereby making the air-water mixture fine and enabling the cooling effect to be improved.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
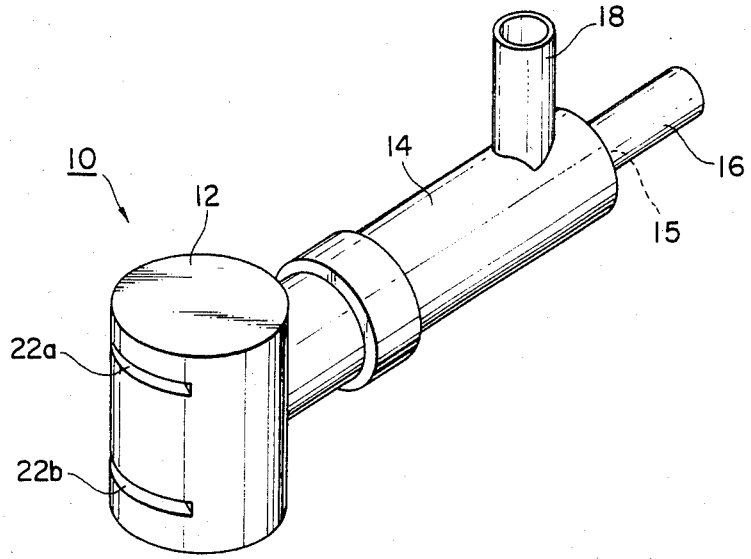
FIG. 1 illustrates a persepctive view of an air-water mist spraying apparatus according to a first embodiment of the present invention.
Figure 2:
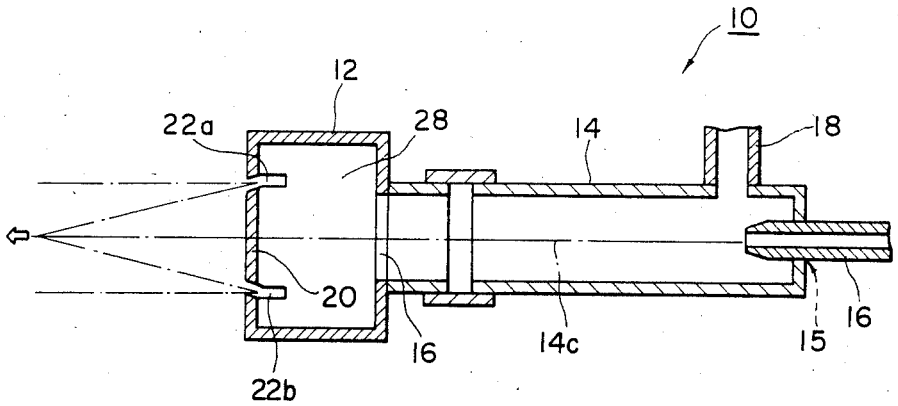
FIG. 2 shows a cross sectional view of the mist spraying apparatus of FIG. 1.
Figure 3:
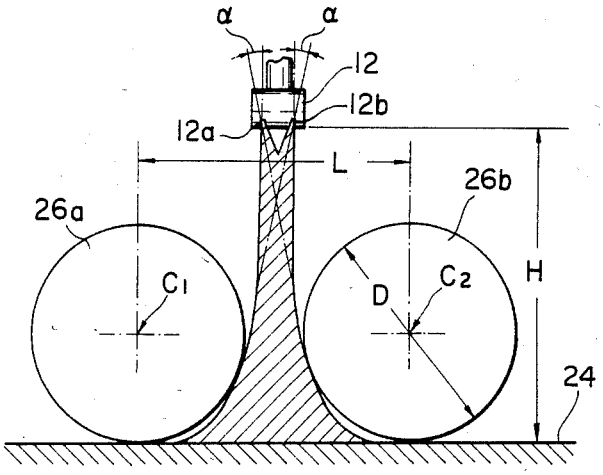
FIG. 3 is an elevation showing the state wherein the cast strand is cooled using the mist spraying apparatus.

In the drawings, a mist spraying apparatus 10 has a cylindrical atomizing nozzle 12 wherein both ends thereof are closed. An air-water mixture supply pipe 14 formed with an introduction inlet 15 is attached to one side of this atomizing nozzle 12 so as to communicate therewith. A water branching pipe 16 for supplying water and an air branching pipe 18 for supplying air are connected to the mixture supply pipe 14, respectively. Exhaust holes 22*a* and 22*b* are formed and open in a air-water mist exhaust side wall 20 of the atomizing nozzle 12 on the side opposite the introduction inlet 15 of the mixture supply pipe 14 so that they are symmetrically formed with respect to the almost central portion of the whole length of the atomizing nozzle 12 (in this embodiment, this central portion substantially coincides with a central line 14*c* of the mixture supply pipe 14). In this case, the exhaust holes 22*a* and 22*b* are directed so that the respective mist spraying streams cross each other before they reach the surface of a cast strand 24. As shown in FIG. 3, although the respective spraying mist streams from the exhaust holes 22*a* and 22*b* cross and collide with each other before they reach the surface of the cast strand 24, the kinetic energy of each spraying mist will not be immediately lost due to the collision. The mixture mist stream after crossing spreads forwardly due to the influence of the kinetic energies in the respective spraying directions and enters the region between guide rollers (26*a* and 26*b*) and a cast strand, so that it is directly sprayed almost the entire region of the surface of the cast strand 24.

Figure 4:
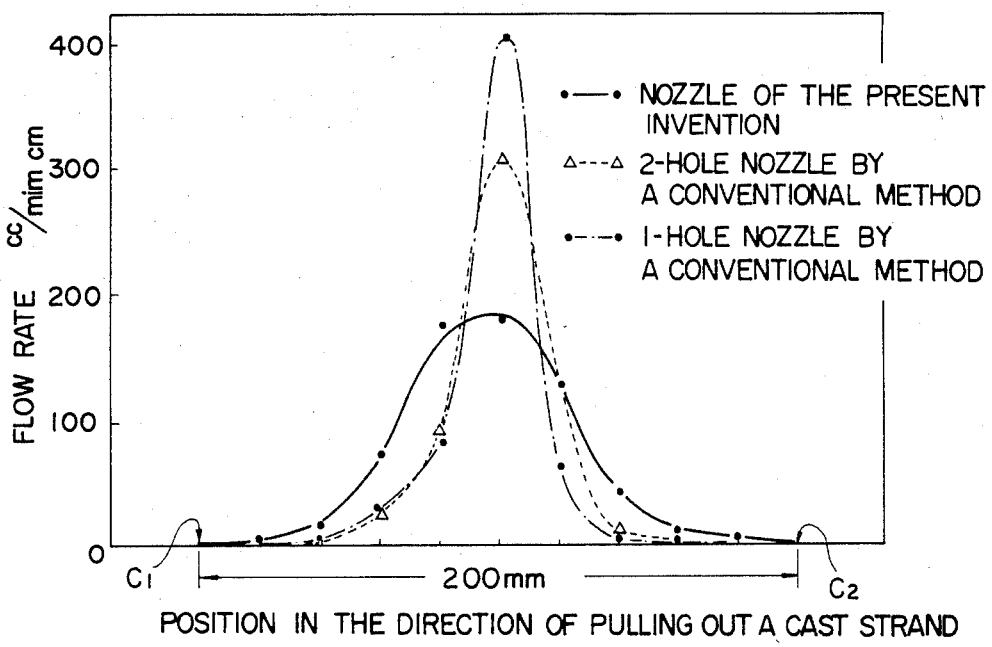
FIG. 4 shows experimental results demonstrating the comparison between the flow rate distributions in the direction of pulling out the cast strand by a conventional method and a method according to the present invention.
Figure 5:
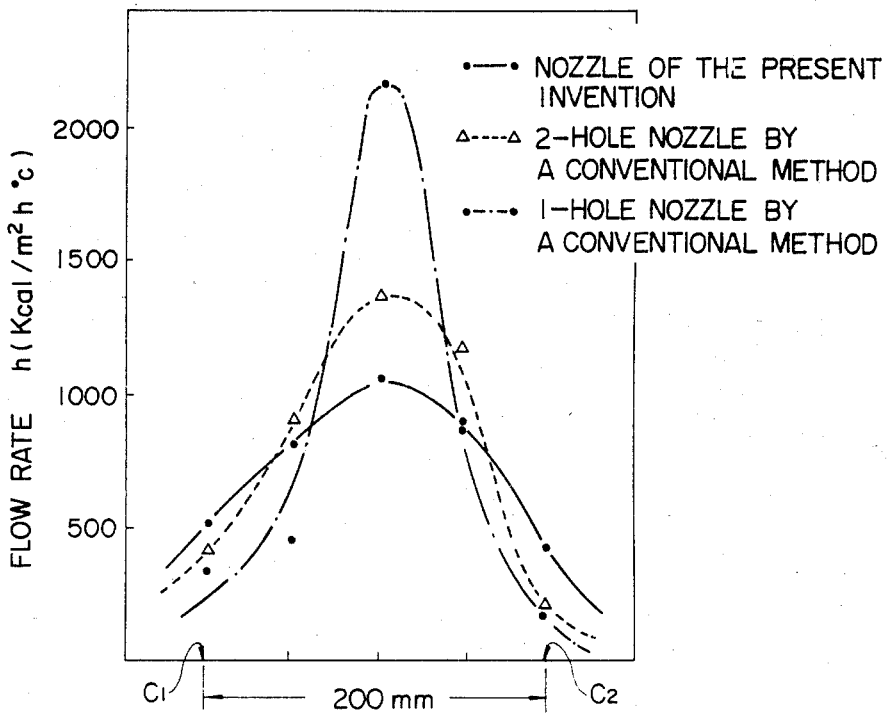
FIG. 5 shows experimental results setting forth the comparison of the heat transfer coefficient distributions in the direction of pulling out the cast strand between by a conventional method and by a method of the present invention.

FIG. 4 shows experimental results representing the comparison of the distributions of the flow rate of the mist on the surface of the cast strand 24 between a conventional method and a method of the present invention such as shown in FIG. 3. FIG. 5 shows experimental results representing the comparison of the distributions of the heat transfer coefficients in the direction of pulling out the cast strand by both methods. As is obvious from these results, it will be easily understood that only the central portion of the cast strand 24 is concentratedly cooled by a conventional exhaust nozzle of the single hole system, so that the cooling rate in the cooled regions of the cast strand 24 (i.e., the surface of the cast strand between a center $C_1$ of the guide roller 26*a* and a center $C_2$ of the guide roller 26*b*) are extremely nonuniform and therefore there is a great possibility that the cast strand undergoes cracking due to the nonuniform cooling. In addition, in case of utilizing a conventional atomizing nozzle of the double hole system, although the concentrated cooling of only the central portion is slightly lightened, the uniformity of cooling rate is not yet enough. On the contrary, in case of using the exhaust nozzle (FIG. 3) of the present invention, the mist is sprayed widely to the whole surface of the cast strand 24 and the cooling efficiency of the entire cast strand 24 is remarkably uniform. Furthermore, the following Table 1 shows the comparison of the mist collection efficiencies on the surface of the cast strand 24 when respective similar exhaust nozzles as mentioned above were used.

TABLE 1

| Atomizing nozzle | Collection efficiency (%) |
|---|---|
| 2-hole nozzle of the inclined type (present invention) | 96.5 |
| 2-hole nozzle of the parallel type (prior method) | 88.0 |
| 1-hole nozzle (prior method) | 79.0 |

As is obvious from these experimental results, the mist collection efficiency of the present invention is much higher than that by conventional methods, and it will be understood that almost all of the spraying mist is effectively utilized, thereby enabling cooling by the mist to be efficiently performed.

Figure 6:
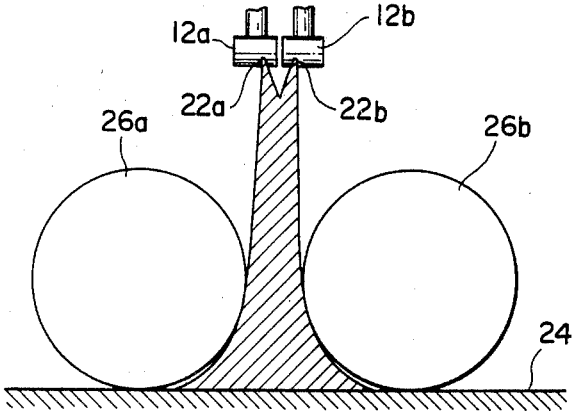
FIG. 6 illustrates an elevational view showing a modification of FIG. 3.

Although, for the mist spraying apparatus, a single spraying apparatus in which the two exhaust holes 22*a* and 22*b* are formed in the mist exhaust side wall 20 has been used, a similar uniform cooling effect can be obtained even by a method having a similar spirit whereby, for example as shown in FIG. 6, a mist spraying apparatus consisting of a pair of atomizing nozzles 12*a* and 12*b* each of which is formed with only a single exhaust hole is disposed so that the respective exhaust holes 22*a* and 22*b* are directed in the same directions as mentioned before with respect to FIG. 3.

Figure 7:
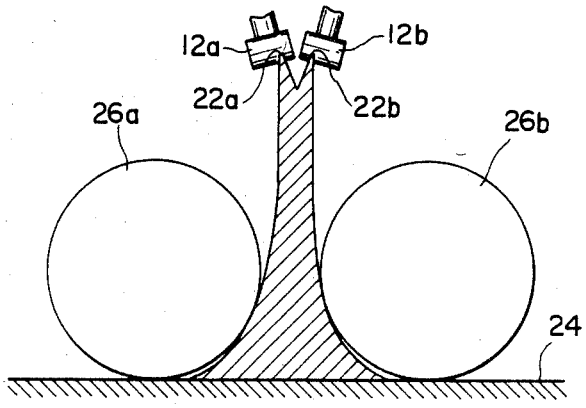
FIG. 7 is an elevational view showing a modification of FIG. 6.

Referring now to FIG. 7 which illustrates another embodiment as a modification of FIG. 6, the exhaust holes 22*a* and 22*b* formed in the respective atomizing nozzles 12*a* and 12*b* are not inclined, but the atomizing nozzles 12*a* and 12*b* are disposed in the oblique directions, thereby directing the exhaust holes 22*a* and 22*b* in the same directions as above, so that a similar effect can be obtained. The spreading state of the mixture mist after crossing is determined by an angle of inclination $\alpha$ (FIG. 3) of the exhaust holes 22*a* and 22*b*. Therefore, the proper setting of the angle $\alpha$ of inclination in accordance with a diameter D of each guide roller 26 in the cooling portion to be applied, a distance L between the guide rollers 26*a* and 26*b* (between the centers $C_1$ and $C_2$) and a distance H from the atomizing nozzle 12 to the surface of the cast strand 24 enables all of the spraying mist to be uniformly sprayed over almost the entire region of the cast strand 24.

Figure 8:
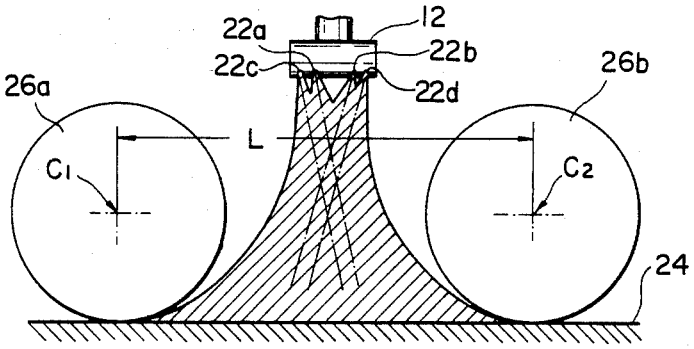
FIG. 8 is an elevation showing another modification of FIG. 3.

The fundamental constitution of the present invention is as described above; however, it is of course effective to provide the cooling mechanism of the present invention using various modifications such as described below on the basis of the abovementioned fundamental concepts. Namely, FIG. 8 illustrates an embodiment where four exhaust holes 22*a*–22*d* are formed in the atomizing nozzle 12 in such a manner that their mist spraying directions cross each other. In this embodiment, since spreading of the mixture mist stream after being crossed can be further widened, this constitution is very effective when the distance L between the guide rollers 26*a* and 26*b* is large.

Figure 9:
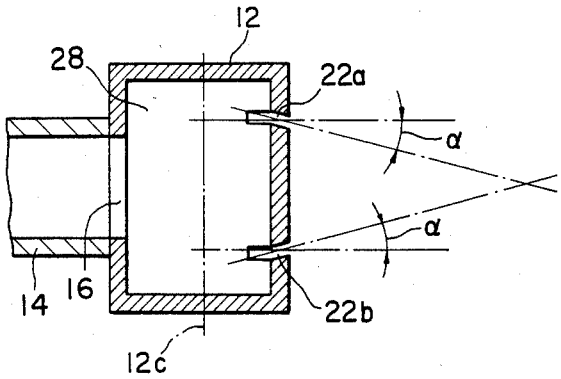
FIG. 9 is a cross sectional view showing an inclination construction of the exhaust holes.
Figure 10:
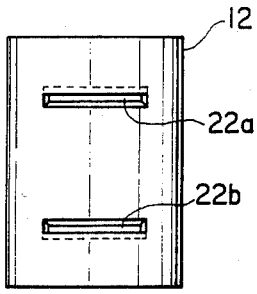
FIG. 10 shows a right side elevational view of FIG. 9.

In addition, as shown in FIGS. 9 and 10, the mist exhaust holes 22*a* and 22*b* are formed so that their shapes become such that the spreading portions of the exhaust holes 22*a* and 22*b* in the circumferential direction of the nozzle 12 exist in planes which cross perpendicularly to a central line 12*c* of the atomizing nozzle 12 and only the opening holes in the exhaust side wall of the nozzle 12 are inclined (at an angle $\alpha$).

Figure 11:
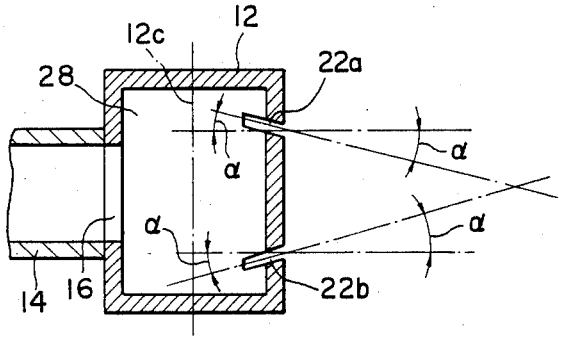
FIG. 11 is a cross sectional view showing an inclination construction of other exhaust holes.
Figure 12:
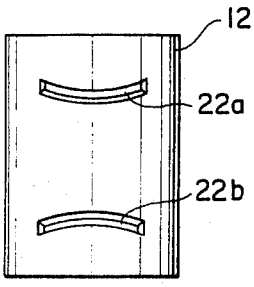
FIG. 12 shows a right side elevational view of FIG. 11.

Furthermore, as shown in FIGS. 11 and 12, the exhaust holes 22*a* and 22*b* are formed so that the spreading portions thereof in the circumferential direction of the nozzle 12 are inclined in the planes which cross at an angle $\alpha$ with respect to the central line 12*c* of the atomizing nozzle 12. Due to this, the cutting and opening operations of the exhaust holes 22*a* and 22*b* become extremely easy.

Figure 13:
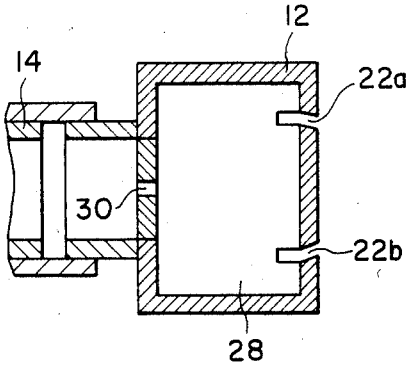
FIG. 13 is a cross sectional view showing another modification.

In the air-water mist cooling method, there is a significant feature in that the cast strand 24 is efficiently cooled by the latent heat of vaporization of the mist which was sprayed on the surface of the cast strand 24. In order to effectively make the most of such a feature, it is desirable to make the spraying droplet of mist as fine as possible. From the viewpoint mentioned above, an atomizing nozzle with a construction such as described below is remarkably effective. That is to say, referring to FIG. 13, an orifice 30 is provided in the introduction inlet 15 of the air-water mixture for a residence chamber 28 in the atomizing nozzle 12. With such a constitution, when the air-water mixture was exhausted and released into the residence chamber 28 after passing through the narrow orifice 30, the fine droplet of mist was formed; therefore, the mist to be sprayed from the exhaust holes 22*a* and 22*b* became extremely fine.

Figure 14:
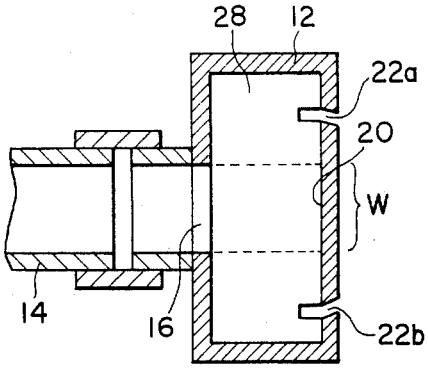
FIG. 14 is a cross section showing a further modification.

On the other hand, as shown in FIG. 14, another method can be considered as the means for forming a fine mist whereby the orifice 30 such as mentioned above is not provided but the exhaust holes 22*a* and 22*b* are formed in the upper and lower portions which are offset from the position in the mist exhaust side wall 30 which faces the opening portion corresponding to the introducing width of the introduction inlet 15. In other words, although the air-water mixture of relatively large particles formed in the mixture supply pipe 14 is introduced as the large particles of the sizes as they are from the intoduction inlet 15 into the residence chamber 28, if the exhaust holes are opened in the exhaust side wall 20 corresponding to the above-mentioned facing width W, a part of the droplets of large particles will not be changed to the fine droplet but will be exhausted from the exhaust holes 22*a* and 22*b*. However, if the exhaust holes 22*a* and 22*b* are formed in positions which are offset from the mist exhaust side wall 20 corresponding to the above-mentioned facing width W, the mixture of large particles to be introduced from the introduction inlet 15 will firstly collide with the exhaust side wall 20 of the residence chamber 28 and will be rebounded. After the mixture repeatedly collides between the inner walls of the residence chamber 28, it is sequentially exhausted from the exhaust holes 22*a* and 22*b* by being pressed by the supply pressure. At this time since the air-water mixture is broken and is changed to the fine droplets due to the collision with the walls and the collision with the air-water mixture particles themselves as mentioned above, the mist to be sprayed from the exhaust holes 22*a* and 22*b* is extremely fine, thereby providing a large cooling effect.

A second embodiment will now be described with reference to FIGS. 15–21. In this embodiment, similar parts and components having the same functions as those of the parts and components in the first embodiment are designated by the same reference numerals.

The cooling mechanism comprises a header 32 disposed in the direction (indicated by an arrow) of pulling out the cast strand 24; a plurality of water branching pipes 34*a*–34*l* connected in a vertical line along the outer peripheral surface of this header 32; and an atomizing nozzle 12 (12*a*–12*l*) attached to the head portion of each water branching pipe 34.

Figure 15:
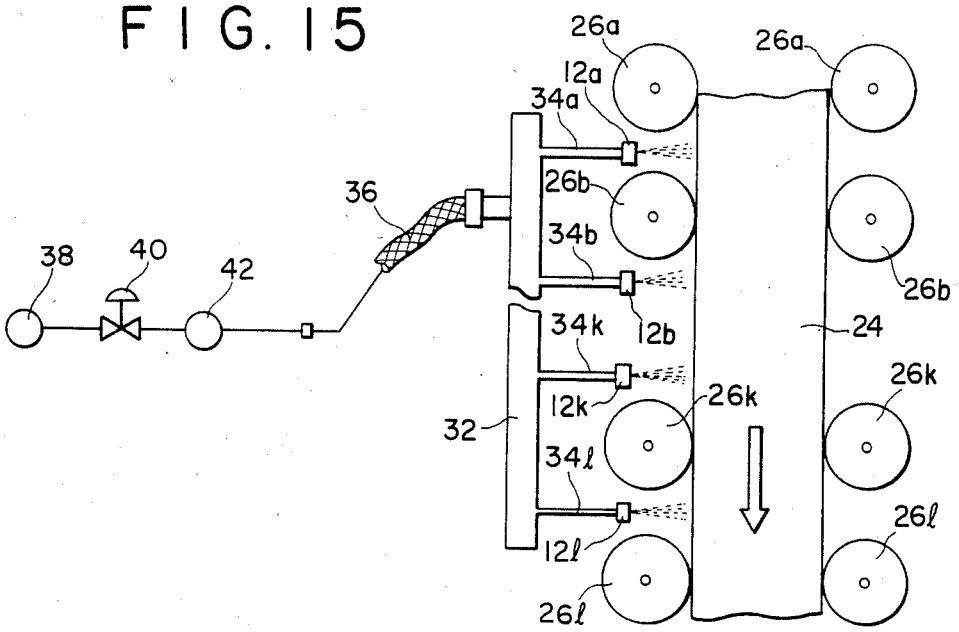
FIG. 15 shows a schematic diagram of the cooling mechanism showing a second embodiment.

The cooling water is supplied from a supply pump 38 through a flow regulating valve 40, a flow meter 42 and a hose 36 to the header 32. The header 32 serves to distribute this cooling water to each water branching pipe 34. The cooling water distributed from each water branching pipe 34 is exhausted from each atomizing nozzle 12 and is sprayed to the cast strand 24 passing between the adjacent guide rollers 26 (i.e., 26*a* and 26*b*; 26*b* and 26*c*; . . . ; 26*k* and 26*l*). In FIG. 15, only one set of headers 32 to which the water branching pipes 34 and atomizing nozzles 12 are attached are shown; however, a plurality of sets of such headers are disposed in the field in order to simultaneously cool two or four surfaces of a cast strand.

Figure 16:
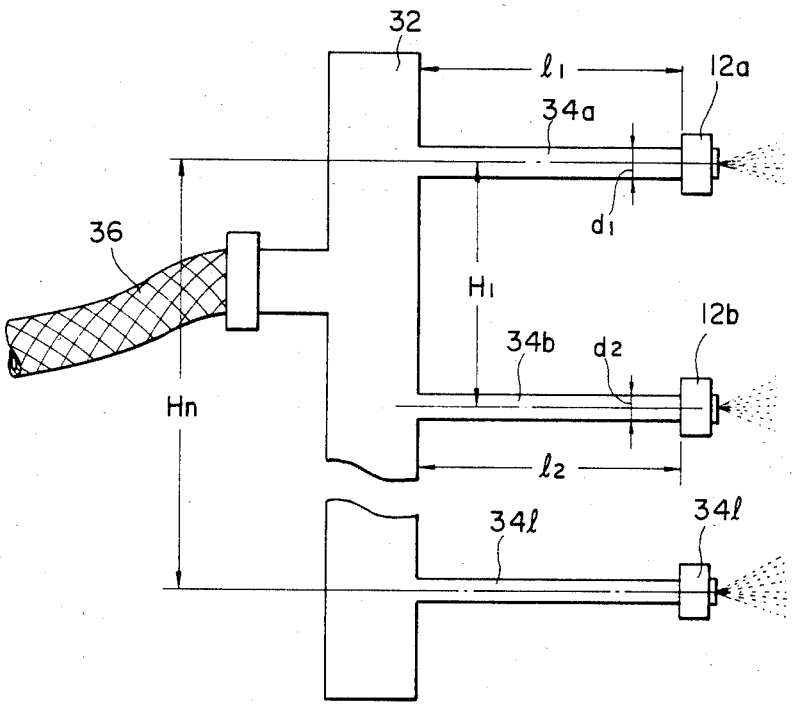
FIG. 16 shows an enlargement of the main part of FIG. 15.

A length l and an inner diameter d of each water branching pipe 34 are obtained using the following arithmetic expression to obtain proper dimensions depending upon the height for attachment of each water branching pipe 34. Firstly, the following relation is well known between the flow rate, Q of the spraying water from the atomizing nozzle 12 and the nozzle back pressure Pn.

$$Q = Cd \cdot A\sqrt{2g \cdot Pn/\gamma} \quad (1)$$

wherein, Cd is a nozzle coefficient, A is a cross sectional area of the nozzle hole, g is gravitational acceleration, and $\gamma$ is a specific weight. Thus, it will be understood that when the same nozzle is used, the flow rate of spraying water Q is determined by the nozzle back pressure Pn. Therefore, the nozzle back pressures Pn at all stages may be set to be identical to make the flow rate of spraying water Q at all stages uniform. As shown in FIG. 16, the atomizing nozzle 12*a* at the highest stage and the atomizing nozzle 12*b* at the second stage will be described for the purpose of clarification. To obtain uniform flow rate of spraying water Q, the nozzle back pressure $Pn_1$ at the highest stage and the nozzle back pressure $Pn_2$ at the second stage are required to be equal; i.e., the following expression has to be satisfied.

$$Pn_1 = Pn_2 \quad (2)$$

The nozzle back pressure $Pn_1$ at the highest stage is the pressure wherein only the loss head $\Delta h_1$ in the water branching pipe 34*a* was subtracted from the inlet pressure $Pe_1$ of the water branching pipe 34*a* at the highest stage; therefore;

$$Pn_1 = Pe_1 - \gamma \cdot \Delta h_1 \quad (3)$$

Now assuming that a length of the water branching pipe is $l_1$ and an inner diameter is $d_1$, the loss head $\Delta h_1$ in the water branching pipe 34*a* at the highest stage is obtained from the following expression.

$$\Delta h_1 = \left(\rho + \lambda \cdot \frac{l_1}{d_1}\right) \frac{v^2}{2g} \quad (4)$$

wherein, $\rho$ denotes a loss coefficient except the pipe friction loss, $\lambda$ is a pipe friction coefficient, and v is the flow velocity of water in the pipe. Therefore, the nozzle back pressure $Pn_1$ at the highest stage is represented by the following expression:

$$Pn_1 = Pe_1 - \left(\rho + \lambda \cdot \frac{l_1}{d_1}\right) \gamma \cdot \frac{v^2}{2g} \quad (5)$$

from expressions (3) and (4).

Similarly to the above expression (3), the nozzle back pressure $Pn_2$ at the second stage is the pressure of which only the loss head $\Delta h_2$ in the water branching pipe 34*b* was subtracted from the inlet pressure $Pe_2$ of the water branching pipe 34*b* at the second stage; therefore, the following expression is satisfied:

$$Pn_2 = Pe_2 - \gamma \cdot \Delta h_2 \quad (6)$$

However, since the inlet pressure $Pe_2$ of the water branching pipe 34*b* at the second stage is higher than the inlet pressure $Pe_1$ of the water branching pipe 34*a* at the highest stage by only a head (or fall) $H_1$, there is the relation:

$$Pe_2 = Pe_1 + \gamma \cdot H_1 \quad (7)$$

Furthermore, assuming that the length of the water branching pipe 34*b* at the second stage is $l_2$ and an inner diameter is $d_2$, the loss head $\Delta h_2$ in the water branching pipe 34*b* at the second stage is represented by:

$$\Delta h_2 = \left(\rho + \lambda \cdot \frac{l_2}{d_2}\right) \frac{v^2}{2g} \quad (8)$$

Similarly to expression (4). Thus, the nozzle back pressure $Pn_2$ at the second stage will be:

$$Pn_2 = Pe_1 + \gamma \cdot H_1 - \left(\rho + \lambda \cdot \frac{l_2}{d_2}\right) \gamma \cdot \frac{v^2}{2g} \quad (9)$$

from expressions (6), (7) and (8).

Therefore, by arranging the above expressions (2), (5) and (9), the result is the relationship:

$$H_1 = \lambda \cdot \frac{v^2}{2g}\left(\frac{l_2}{d_2} - \frac{l_1}{d_1}\right)$$

By further arranging this expression, following relationship exists:

$$\frac{l_2}{d_2} = \frac{l_1}{d_1} + \frac{2g \cdot H_1}{\lambda \cdot v^2} \quad (10)$$

Therefore, according to expression (10), it is possible to obtain the length $l_2$ of the water branching pipe 34*b* at the second stage and the inner diameter $d_2$.

In the similar manner as above, it is possible to determine the length l and inner diameter d of the water branching pipe 34 at each stage which can eliminate the influence by the difference in water pressure. However, in the case where it is difficult to manage various kinds of water branching pipes 34 in the field, it is also possible to divide the headers 32 into several stages and to integrate the dimensions of the water branching pipes in each group.

Figure 17:
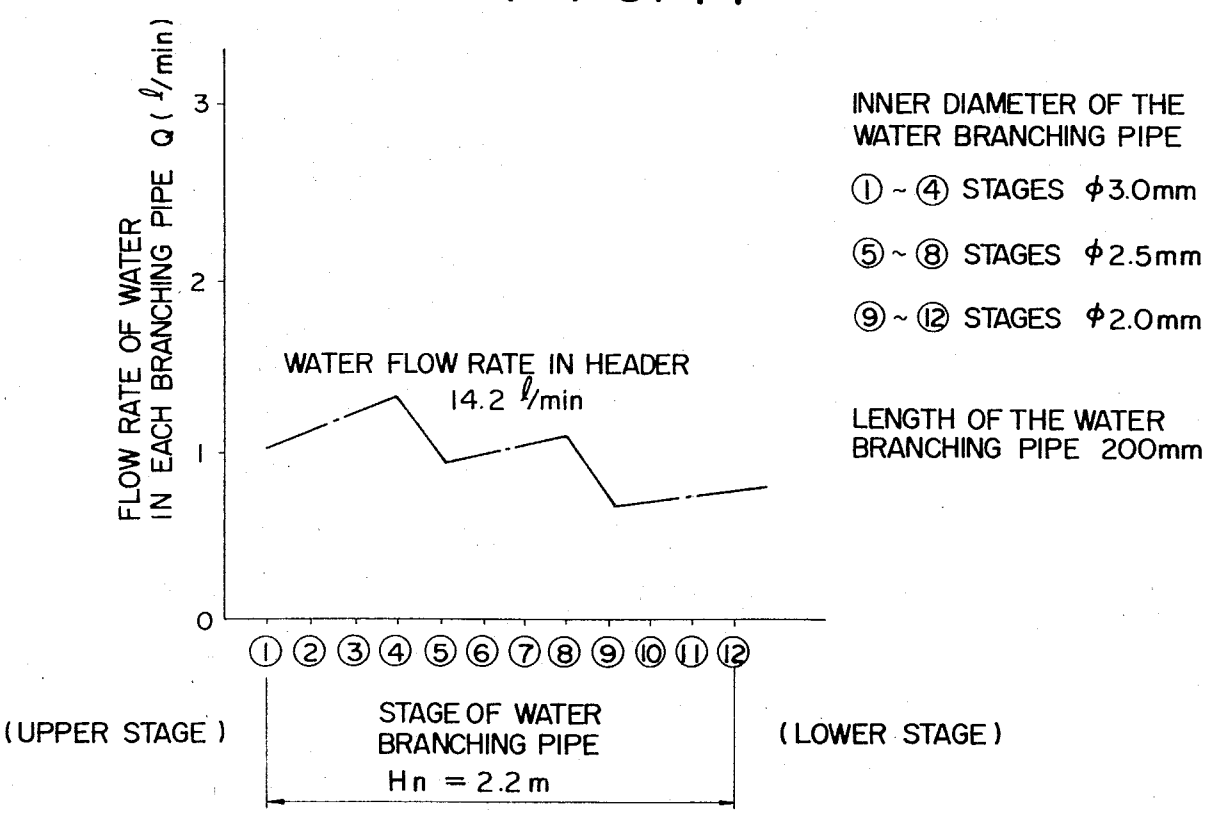
FIG. 17 shows a diagram representing the calculation result of the quantity Q of the spraying water.

Examples of calculations of the flow rate of spraying water Q for each stage of the water branching pipes 34 obtained from the above expression (10) are shown in the drawings. FIG. 17 shows the calculated result of the flow rate of spraying water Q under the conditions such that the water branching pipes are disposed vertically at regular intervals; the head $H_n$ from the highest stage to the 12th stage is 2.2 m; the length l of each water diverging pipe is 200 mm; the inner diameter d of each water branching pipe at the upper first to fourth stages is 3.0 mm; the inner diameter d of the same at the fifth to eighth stages is 2.5 mm; the inner diameter d of the same at the ninth to 12th stages is 2.0 mm; and the flow rate of the water to be supplied to the header 32 (hereinbelow, referred to as a flow rate of water in a header) is 14.2 l/min. On the other hand, to understand the nonuniformity of the flow rate of water Q to be caused due to the water pressure difference, examples of calculations with regard to the relation between the inlet pressure Pe of the water branching pipe and the flow rate of water Q are shown in Table 2 and FIG. 18.

TABLE 2

| Number of water branching pipes | Inlet pressure of water branching pipes (Pe) | Flow rate of water (Q) |
|---|---|---|
| 1 | 0.05 mAq | 1 l/min |
| 2 | 0.75 mAq | 3.8 l/min |
| 3 | 1.45 mAq | 5.3 l/min |
| 4 | 2.15 mAq | 6.3 l/min |

These calculation examples were obtained under the conditions such that the water branching pipes at the total four stages are disposed vertically at regular intervals; the head $H_n$ from the first stage to the fourth stage is 2.1 m; the flow rate of water in a header is 16.5 l/min; the length l of each water branching pipe is 200 mm; and the inner diameter d of each pipe is 6.5 mm. Furthermore, since there is a case where the nozzle back pressure Pn suddenly decreases when the flow rate of water is low, the relation between the flow rate of water Q and the nozzle back pressure Pn in case of using commercially available nozzles for water spray at the time of low flow rate of water is also shown in FIG. 19 as a reference.

Figure 18:
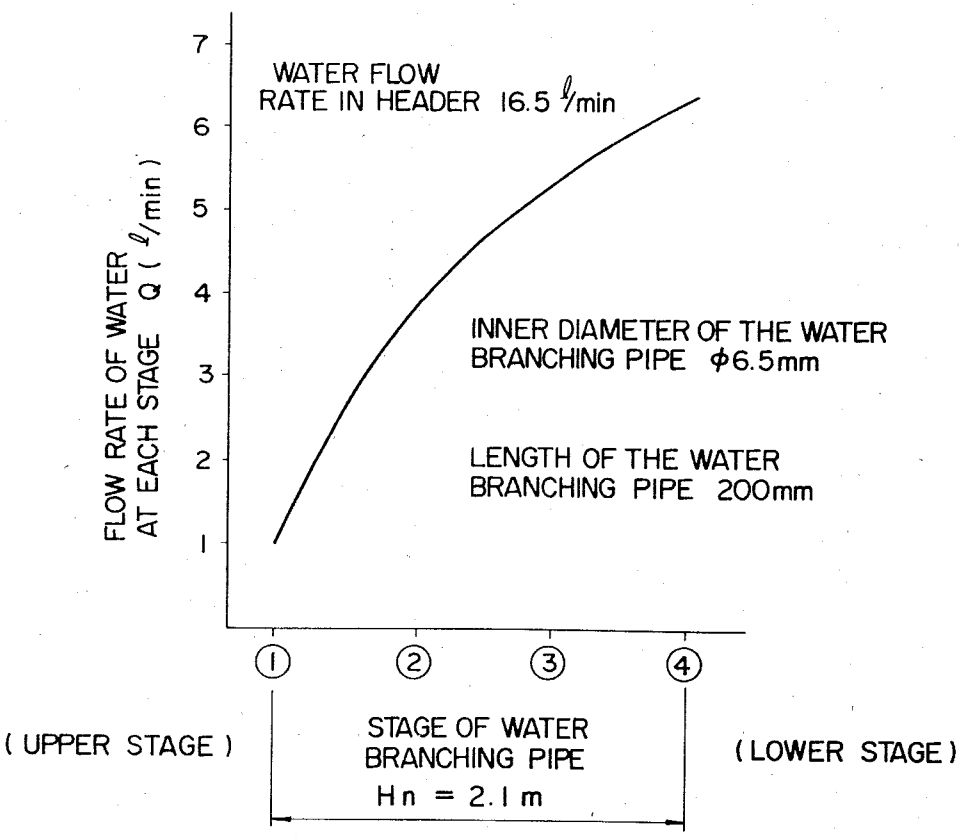
FIG. 18 shows a diagram representing the calculation result with respect to the relation between the pressures and flow rate of the spraying water.
Figure 19:
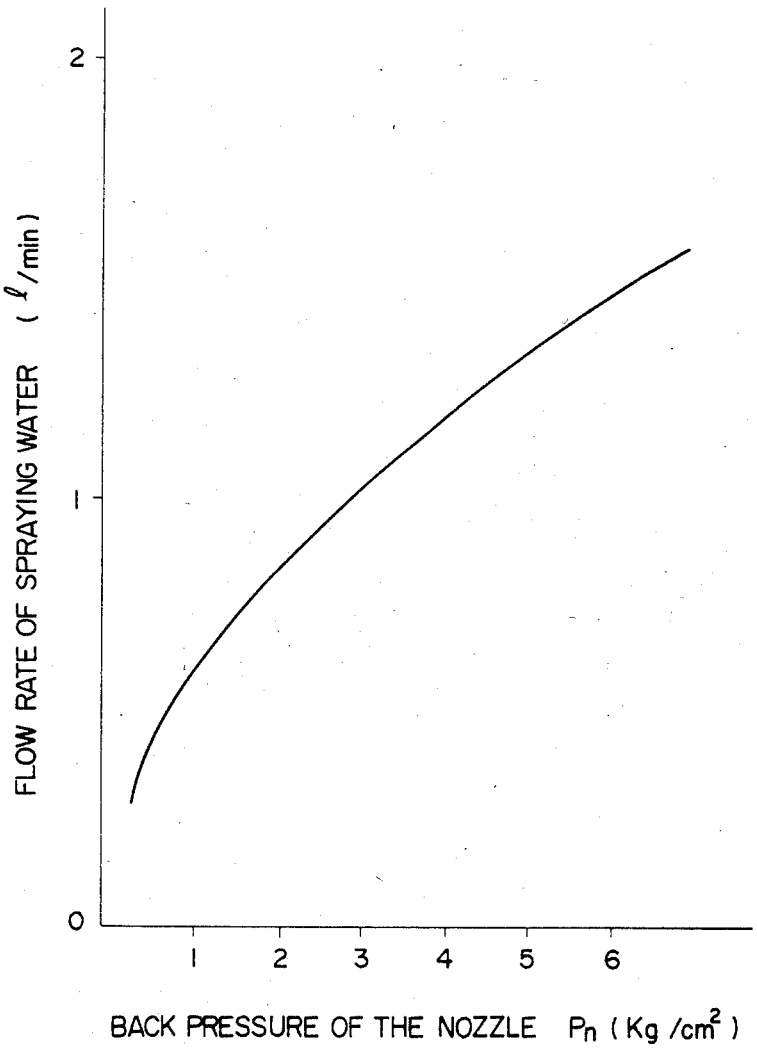
FIG. 19 shows characteristics of a commerically available water spray nozzle when the flow rate of the water is small.

When studying FIG. 17 in consideration of the characteristics of FIGS. 18 and 19, it is obvious that the inner diameter of each water branching pipe 34 obtained by the arithmetic expressions according to the present invention is useful to secure the uniformity of the flow rate of water Q.

Figure 20:
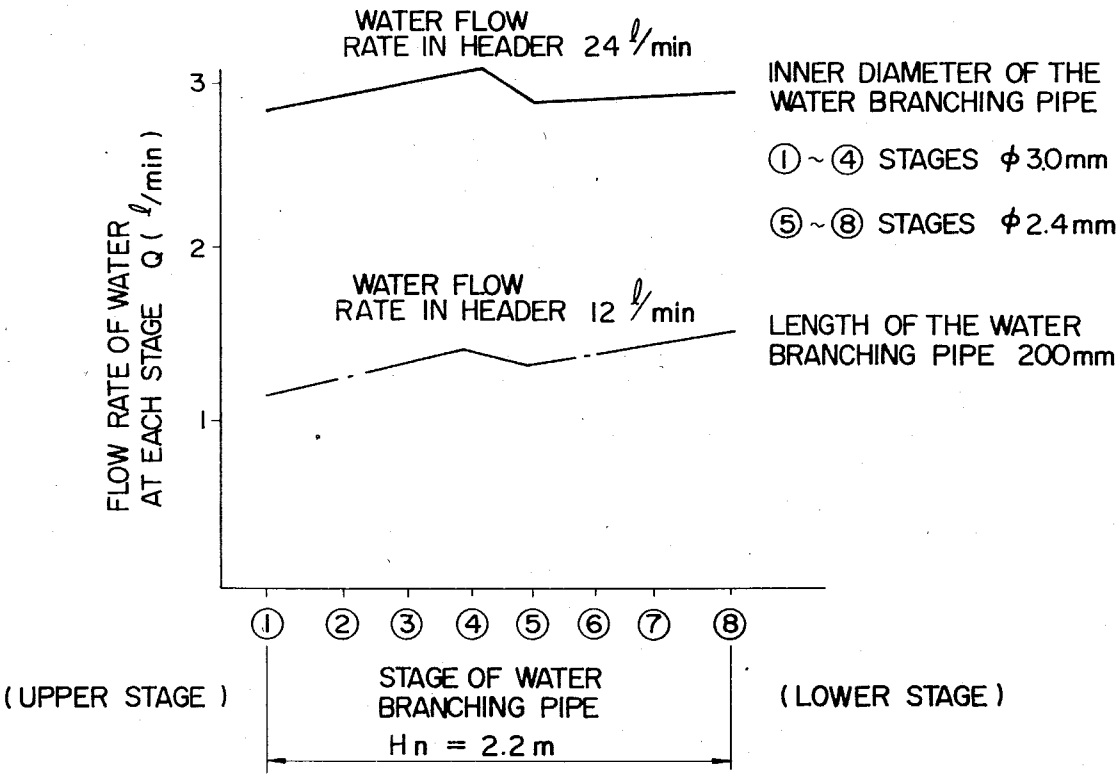
FIGS. 20 and 21 show diagrams representing the measurement results of the flow rate of the spraying water.
Figure 21:
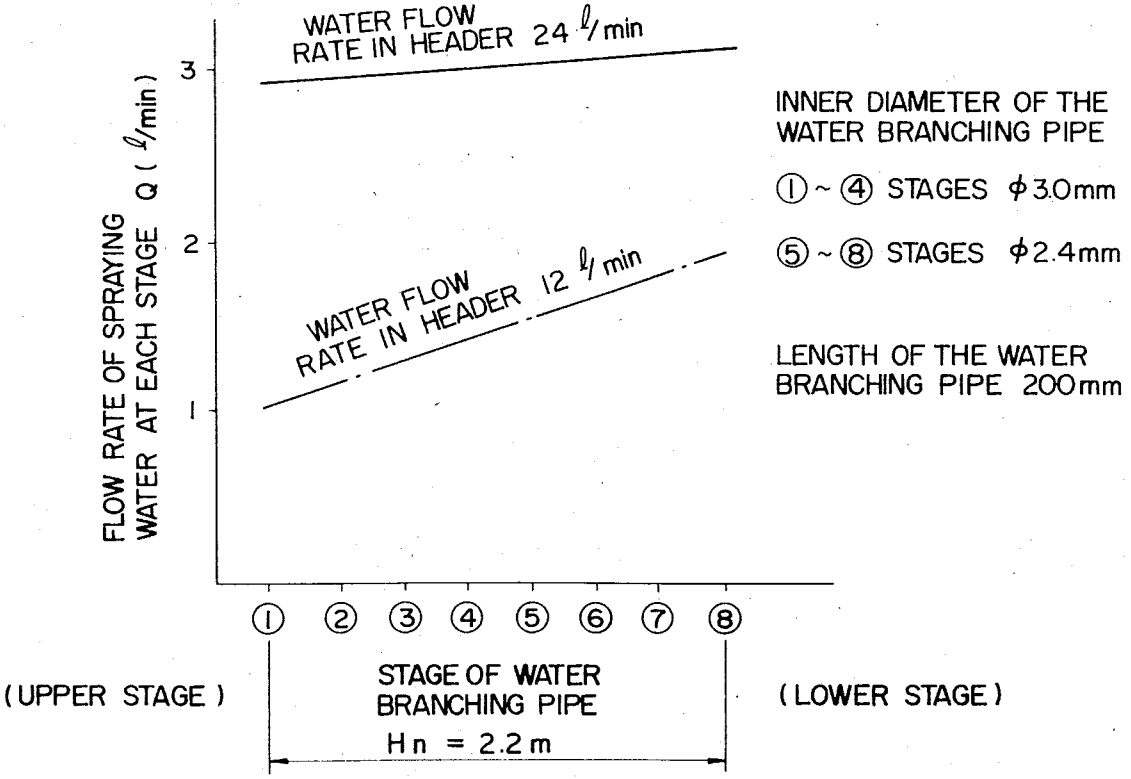

Next, the results of measurements of the flow rate of water Q whereby the water branching pipes 34 obtained from the above expression (10) were attached to the header 32 disposed vertically are shown in the drawings. FIG. 20 shows the measured result of the flow rate of water Q under the conditions such that the water branching pipes 34 are vertically disposed at regular intervals; the head $H_n$ from the highest stage to the 8th stage is 2.2 m; the length l of each water branching pipe 34 at every stage is 200 mm; the inner diameter d of each water branching pipe at the highest to 4th stages is 3.0 mm; and the inner diameter d of the same at the 5th to 8th stages is 2.4 mm. In addition, the flow rate of water in a header was set at 24 l/min and 12 l/min. For comparison, FIG. 21 is also presented. Namely, FIG. 21 shows the measured results of the flow rate of water Q under the conditions where the water branching pipes 34 are vertically disposed at regular intervals; the head $H_n$ from the highest to 8th stages is 2.2 mm; the length l of each water branching pipe 34 at every stage is 200 mm; and the inner diameter d of each pipe at every state is 3.0 mm. Also, the flow rate of water in a header was set to be 24 l/min and 12 l/min.

As is obvious from FIG. 20, it will be understood that in spite of the fact that the head $H_n$ between the upper and lower ends of the header 32 is large, the distribution of the flow rate of water Q at each stage has practically an effective uniformity. More particularly in comparison with FIG. 21, it will be appreciated that the present invention is excellent when the flow rate of water in a header is low (12 l/min). In addition, if the inner diameter of each water branching pipe 34 is also made smaller to increase the pressure loss in each water branching pipe, it is also possible to improve the distribution characteristic of the flow rate of water Q in the low flow rate range. However, it is desirable to set the minimum inner diameter of each water branching pipe 34 at about 2 mm or more in consideration of choking and the maximum and minimum values of the flow rate of water to be used for the secondary cooling material.

Figure 22:
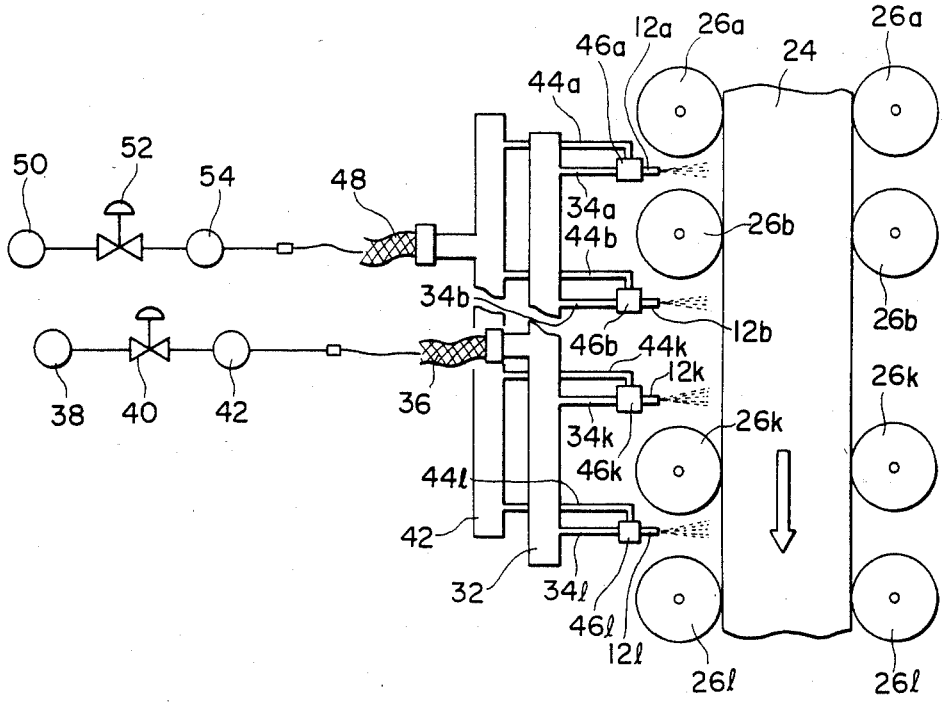
FIG. 22 illustrates a schematic diagram of a third embodiment.
Figure 23:
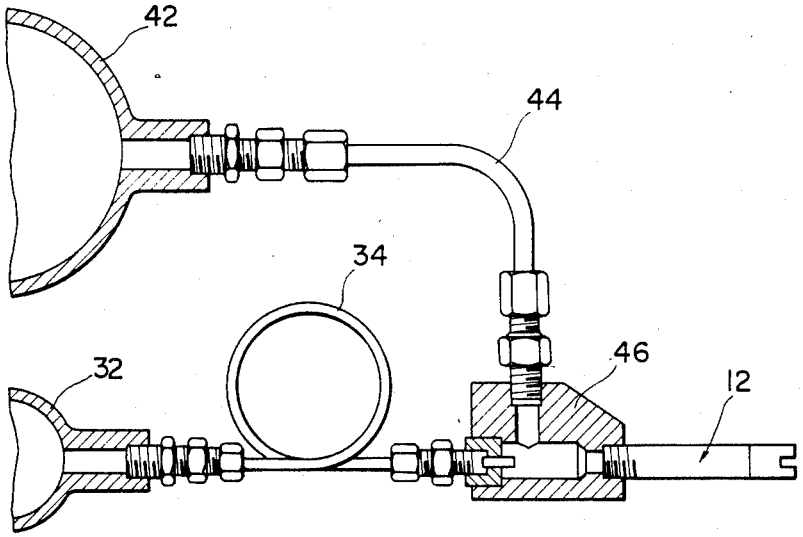
FIG. 23 illustrates an enlargement of the main part of FIG. 22.

FIGS. 22 and 23 illustrate a third embodiment, in which the continuous cast strand 24 is cooled by a mixture mist consisting of air and cooling water. The water header 32 and air header 42 are disposed in parallel along the direction (indicated by an arrow) of pulling out the cast strand 24. Air branching pipes 44 (44*a*–44*l*) connected to the air header 42 are respectively connected through mixing portions 46 (46*a*–46*l*) of the atomizing nozzle 12 to the respective water branching pipes 34 (34*a*–34*l*) connected to the header 32. As shown in FIG. 23, if a detachable pipe fitting is used for connecting the air branching pipe 44 to the atomizing nozzle 12, it will be convenient for repair and the like when choking occurs. The air for air-water mixture mist is supplied from a compressor 50 through a flow regulating valve 52, a flow meter 54 and an air hose 48 to the air header 42.

The present invention serves to obtain a uniform flow rate of water Q by setting the length l of each water branching pipe 34 at every stage at a constant value and by making the inner diameter d of each water branching pipe 34 sequentially smaller toward the lower stage. However, it is of course possible to slightly adjust the length l of the respective water branching pipes 34 in the field.

What is claimed is:

1. Continuous metal casting equipment comprising:

(a) at least two guide rollers which, during use of the metal casting equipment, contact a metal strand being cast, said guide rollers being spaced apart from one another in the direction of movement of the strand;

(b) a cylindrical nozzle, said cylindrical nozzle being cylindrical about an axis which is parallel to the direction of movement of the strand, the interior of said cylindrical nozzle defining a cylindrical residence chamber, said cylindrical nozzle being located on the side of a plane parallel to the strand and passing through the axes of said at least two guide rollers opposite to the strand and having a central line which is perpendicular to and intersects said axis of said cylindrical nozzle, the extension of said central line passing midway between said at least two guide rollers;

(c) an air-water mixture supply pipe sized, shaped, and positioned so that, during use of the metal casting equipment, it introduces a stream comprising a mixture of air and water into said cylindrical residence chamber concentrically to said central line; and (d) at least two spaced exhaust holes formed in said cylindrical nozzle on the side thereof adjacent to said at least two guide rollers, said at least two spaced exhaust holes being equidistant from said central line and being separated by an imperforate surface against which, during use of the metal casting equipment, the stream of air and water impinges and is broken into a fine mist, each of said at least two spaced exhaust holes being sized and shaped so that the spray emitted therefrom during use of the metal casting equipment is fan shaped in cross-section in the plane which includes said axis of said cylindrical nozzle and said central line and is bounded by a first line which is parallel to said central line and tangental to the adjacent one of said guide rollers and a second line which is inclined inwardly towards said central line, said at least two spaced exhaust holes and said cylindrical nozzle being sized, shaped, and positioned so that the sprays emitted by said at least two spaced exhaust holes during use of the metal casting equipment cross each other between said cylindrical nozzle and the strand and so that the spray emitted by each one of said at least two spaced exhaust holes during use of the metal casting equipment impinges upon a portion of the strand which is on the opposite side of a plane which is perpendicular to the strand and tangential to the farther removed one of said at least two guide rollers.

2. Continuous metal casting equipment as recited in claim 1 wherein each of said at least two spaced exhaust holes is in the form of an arcuate slot which is symmetrical with respect to the plane which includes said axis of said cylindrical nozzle and said central line and the center of which is closer to said central line than are the ends.

3. Continuous casting equipment comprising:

(a) at least three guide rollers which, during use of the metal casting equipment, contact a metal strand being cast vertically downwardly, said guide rollers being spaced apart from one another in the vertical direction;

(b) a header which extends vertically on the opposite side of said at least three guide rollers from the strand;

(c) means for supplying water to said header;

(d) a nozzle located between each adjacent pair of said at least three guide rollers and on the side of a plane parallel to the strand and passing through the axes of said at least three guide rollers opposite to the strand; and (e) a branching pipe connecting each of said nozzles to said header, each of said branching pipes being at least approximately the same length but the inside diameter of said branching pipes varying so that each of said nozzles delivers water at at least approximately the same flow rate despite differences in head pressure in said header, the inside diameter of said branching pipes being calculated according to the formula:

$$\frac{l_2}{d_2} = \frac{l_1}{d_1} + \frac{2g \cdot H_1}{\lambda \cdot V^2}$$

where $l_1$ equals the length of the highest one of said branch pipes, $l_2$ equals the length of the next highest one of said branch pipes, $d_1$ equals the diameter of the highest one of said branch pipes, $d_2$ equals the diameter of the next highest one of said branch pipes, g is gravitational acceleration, $H_1$ is the difference in head pressure between the highest and the next highest of said branch pipes, $\lambda$ is the pipe friction coefficient of said branch pipes, and V is the flow velocity of water in said branch pipes.

4. Continuous metal casting equipment as recited in claim 3 wherein:

(a) said nozzles are cylindrical about a vertical axis;

(b) the interior of said nozzles define cylindrical residence chamber;

(c) each of said nozzles has a central line which is perpendicular to and intersects said vertical axis and the extension of which passes midway between the associated pair of said guide rollers;

(d) the one of said branch pipes associated with each of said nozzles is shaped and positioned so that, during use of the metal casting equipment, it introduces a stream comprising a mixture of air and water into said cylindrical residence chamber concentrically to said central line;

(e) at least two spaced exhaust holes are formed in each of said nozzles on the side thereof adjacent to said guide rollers;

(f) said at least two spaced exhaust holes are equidistant from said central line and are separated by an imperforate surface against which, during use of the metal casting equipment, the stream of air and water impinges and is broken into a fine mist;

(g) each of said at least two spaced exhaust holes are sized and shaped so that the spray emitted therefrom during use of the metal casting equipment is fan shaped in cross section in the plane which includes said vertical axis and said central line and is bounded by a first line which is parallel to said central line and tangential to the adjacent one of said guide rollers and a second line which is inclined inwardly towards said central line; and (h) said at least two spaced exhaust holes and said nozzles are sized, shaped, and positioned so that the sprays emitted by said at least two spaced exhaust holes during use of the metal casting equipment cross each other between said nozzles and the strand and so that the spray emitted by each one of said at least two spaced exhaust holes during use of the metal casting equipment impinges upon a portion of the strand which is on the opposite side of a plane which is perpendicular to the strand and tangential to the further removed one of the associated pair of said guide rollers.

5. Continuous metal casting equipment as recited in claim 4 wherein each of said at least two spaced exhaust holes in each of said nozzles is in the form of an arcuate slot which is symmetrical with respect to the plane which includes said vertical axis and said central line and the center of which is closer to said central line than are the ends.

* * * * *